US006927749B1

(12) United States Patent
Klemm

(10) Patent No.: US 6,927,749 B1
(45) Date of Patent: Aug. 9, 2005

(54) LCD DISPLAY WITH FAILURE CONTROL

(75) Inventor: Thomas Klemm, Mannheim (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 0 days.

(21) Appl. No.: 09/786,563

(22) PCT Filed: Sep. 4, 1999

(86) PCT No.: PCT/EP99/06523

§ 371 (c)(1),
(2), (4) Date: Jun. 26, 2001

(87) PCT Pub. No.: WO00/14599

PCT Pub. Date: Mar. 16, 2000

(30) Foreign Application Priority Data

Sep. 8, 1998 (DE) ..... 198 40 952

(51) Int. Cl.[7] ..... G09G 3/04
(52) U.S. Cl. ..... 345/33; 345/34; 345/50; 345/51
(58) Field of Search ..... 345/33, 34, 37, 345/50, 51

(56) References Cited

U.S. PATENT DOCUMENTS

| | | | | |
|---|---|---|---|---|
| 3,938,140 A | 2/1976 | Garcia et al. | ..... | 340/336 |
| 4,412,214 A | 10/1983 | Tanaka et al. | ..... | 340/765 |
| 5,392,546 A * | 2/1995 | Bailey | ..... | 40/450 |
| 6,344,838 B1 * | 2/2002 | Jaeggi | ..... | 345/51 |

FOREIGN PATENT DOCUMENTS

| | | | | |
|---|---|---|---|---|
| EP | 0486922 A2 | 5/1992 | ..... | G01R 31/28 |
| EP | 0486922 A3 | 5/1992 | ..... | G01R 31/28 |
| EP | 0486922 B1 | 5/1992 | ..... | G01R 31/28 |
| GB | 2005059 A | 4/1979 | ..... | G09F 1/13 |

* cited by examiner

*Primary Examiner*—Alexander Eisen
*Assistant Examiner*—Kimnhung Nguyen
(74) *Attorney, Agent, or Firm*—Sujatha Subramaniam; Roche Diagnostics Operations, Inc.

(57) ABSTRACT

Liquid crystal display with conductive segments for representing symbols which also has at least one inverse segment that fills at least in part the display area that is not covered by the remaining segments. This liquid crystal display allows a simple, visual detection of faulty segments. For this purpose a check is carried out in which all segments and all existing inverse segments are activated which results in a homogenous image when the display is completely functional or the faulty segments are inversely displayed in relation to the remaining display surfaces.

12 Claims, 1 Drawing Sheet

LCD DISPLAY WITH FAILURE CONTROL

Figure 1:
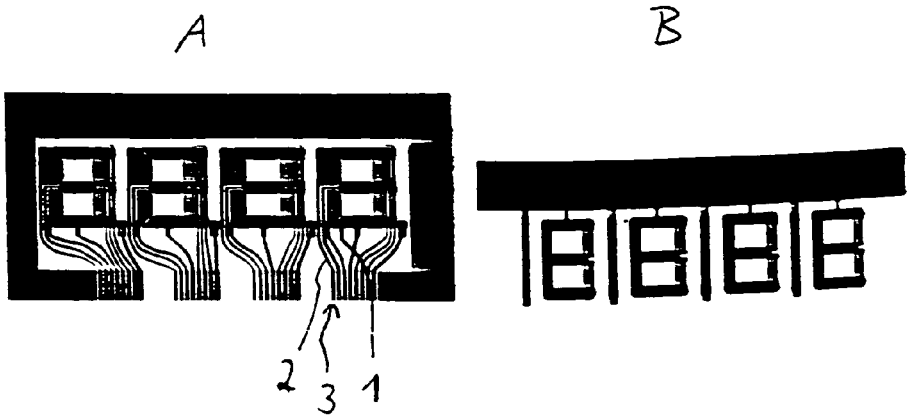
Fig 1 ( Prior Art )

The present invention concerns a liquid crystal display which allows a visual detection of faulty segments. In the display a first and a second plate face one another and there is a liquid crystalline substance in the space between the first and second plate. The first plate is transparent to incident light and has essentially transparent conductive segments for representing symbols in a display area. The second plate is conductive in at least certain areas. According to the invention at least one conductive inverse segment is present on the first plate which at least partially fills the display area that is not covered by the segments for displaying symbols. This liquid crystal display enables a simple visual detection of faulty segments. For this purpose a control is carried out in which all segments and all existing inverse segments are activated resulting in a homogeneous image when the display is completely functional or an inverse display of faulty segments relative to the remaining display surface.

The present invention relates to the field of information transmission by liquid crystal displays. Liquid crystal displays have gained acceptance in many fields for the display of alphanumeric characters or symbols e.g. for clocks, pocket calculators and such like. However, a problem which frequently occurs in practice is failure of individual segments of the liquid crystal display which can be caused by faulty contacts, breaks in the circuit paths, defective drive circuits etc. Defective segments of an LCD display can have fatal consequences especially in the medical field and also in many other fields. If for example the middle cross-line fails in a conventional 7-segment display, an 8 is shown as 0 and the user or the doctor receive erroneous information. Another critical example is the representation of a decimal point, the absence of which leads to completely false results. The object of the present invention was therefore to propose a liquid crystal display which allows a simple and reliable detection of segment failures by the user.

Methods are already known from the prior art which help to avoid erroneous information transfer due to segment failure. A 7-segment display is disclosed in the German Patent application 2332970 which has a further one or two segments that run diagonally in addition to the conventional 7 segments. The use of these additional segments can ensure that a symbol is displayed when one of the segments required for the display fails which the user can recognize as being distorted. The unusual display of the symbol therefore acts as a warning for the observer. However, the said display has the disadvantage that the user has to take special care when reading the display in order to see whether the symbols are displayed correctly. Such a display bears the risk that the user mentally amends the missing segment when reading the display too quickly and thus the warning is lost.

A display is described in U.S. Pat. No. 5,559,528 having redundant segments. In this display additional segments are provided which extend parallel to the conventional segments and thus when there is a failure of one of the segments the other can continue to provide correct transmission of information. However, a disadvantage of such a display is that a plurality of individual segments have to be separately activated which greatly increases the complexity of the electronic control device as well as of the display itself. A further disadvantage is that for many symbols the use of redundant segments leads to displays that are confusing for the user. Thus if for example a bell such as that known for alarm clocks has to be represented, then two such bells have to be represented next to one another when using redundant segments which are both displayed even in the normal case i.e. when the segments function properly. In such a case the user will be irritated by whether the double display of the alarm bell holds any special information.

A further method for the control of liquid crystal displays is known in the prior art in which all existing segments are firstly activated when the display is switched on. The observer can now visually check whether the 7-segment display has the usual figure 8 shape or whether individual segments are absent. Apart from the disadvantage that this method can only be used for displays in which the operator knows the correct appearance of the segments, another disadvantage is that errors in the display may escape the notice of the operator due to inattentiveness.

A liquid crystal display is described in the German open-laid document DE 37 04 031 which has control segments that are electrically connected in series to the regular display segments. Furthermore supplementary segments are described which are disposed next to the control segments and together with these form a conspicuous symbol. With this arrangement it is possible to check whether the supply to a control system and to a regular segment connected thereto is intact. However, it is not possible to interrupt the conducting path between the control symbol and the corresponding regular segment with this arrangement.

The area occupied by the inverse segment or the region occupied by the inverse segments should be such that the regular segments are surrounded by the inverse segments. Thus when the regular segments are activated together with the inverse segments this results in a surface which appears homogeneous to the observer whereas a segment that has failed appears inversely to the observer.

It is also possible to provide the inverse segment or segments in only that part of the display area in which it is particularly important to detect a segment failure.

The present invention discloses a liquid crystal display which enables a visual detection of faulty segments in a simple and reliable manner. For this purpose the liquid crystal display has one or several segments which essentially fill out the display area that is not covered by the conventional segments and which are referred to as inverse segments in the present invention in addition to the conventional segments for representing alphanumerical characters or symbols. Hence the display of an inventive display device can also be made from conventional displays by adding inverse segments. However, in the manufacture of the displays according to the invention the inverse segments are usually mounted or exposed in the same manufacturing step as the regular segments (e.g. by etching processes).

The present invention also includes systems in which the liquid crystal displays according to the invention are integrated. The systems have an actuation device for the liquid crystal display which can be used to implement the method for checking the display and for representing symbols described above. The systems can also preferably have a switch or suchlike to start the display check so that the operator can check the display at any time he chooses.

A liquid crystal display according to the invention has a first and a second plate which face one another and in which a liquid crystalline substance is present in the space between them. At least one of the two plates is transparent so that the operator can perceive a change in the optical properties of the liquid crystalline substance through this plate. The basic construction of liquid crystal displays is known in the prior art and hence only important details in connection with the invention are described in this application. A detailed compilation of suitable liquid crystalline substances and the structure and function of liquid crystal displays is given in Ullmanns Encyclopedia under the keyword "liquid crystals".

The present invention can be applied to liquid crystal displays which operate in the transmission as well as in the reflection mode. Consequently one of the said plates is transparent and the other plate can either be transparent or reflecting. Furthermore the invention is not limited to a special display system but can be generally used for systems in which an optically perceivable change of the liquid crystalline substance is caused by an electrical field. For example the principle of dynamic scattering, the principle of deformation of aligned phases and display systems based on the so-called Schadt-Helfrich effect are described in Ullmanns Encyclopaedia of technical chemistry. Especially the latter technique can be readily used in many cases and is characterized by its long operating times and the low power consumption. In display systems based on the Schadt-Helfrich effect the liquid crystalline substance is located between crossed polarizers and the layer thickness of the liquid crystalline substance is selected such that the light is subjected to a phase shift of 90°. Hence such a display appears transparent when the display is not activated. Application of an electrical potential of ca. 1 to 5 volts reorientates the liquid crystalline phase and the display appears opaque in the regions in which the reorientation has occurred.

Generally an electrical field is used to activate liquid crystal displays. For this transparent conducting layers are placed on the plates between which the liquid crystalline substance is located. In the case of a reflecting display the conducting layer applied in front of the reflecting layer can optionally be made to be impermeable to light and reflective. Transparent conducting layers can be generated by vapour-depositing or sputtering tin (IV) oxide layers doped with antimony or indium (III) oxide layers doped with tin (IV) oxide.

The conducting layers are given the shape of segments in order to represent symbols with the liquid crystal display. The term "segments" is used in the present invention to denote individual segments of conventional segment displays as well as symbols such as alarm bells, arrows, stylised thermometers and such like. The segments are connected by leads to contacts at the periphery of the plate on which the segments are located. The electrical leads are also made of transparent conducting layers. If the conductive layer on the opposing plate is transparent the electrical leads also appear on the display when the respective segments are activated. However, this is undesirable and hence the counterelectrode on the second plate is usually designed such that a substantial electrical field is only formed between the segments to be displayed and the counterelectrode but not between the leads and the counterelectrode. This is shown in more detail in FIG. 1 which shows a liquid crystal display of the prior art. FIG. 1A shows the electrodes which are mounted on a plate of a liquid crystal display. The figure shows the segments (1), their leads (2) and the contacts (3). FIG. 1B shows a counter-electrode which is disposed such that the conducting paths that are perceptible as an eight are situated in the display opposite the corresponding eight of FIG. 1A. Since there are no counterelectrodes in the area of the leads and contacts, these do not appear in the liquid crystal display even if there is a potential difference between them and the counterelectrode. In so-called multiplex displays the counterelectrode can also be composed of segments that can be individually activated. As a result the electrical field can be limited to the desired region of the display. Multiplex displays require a counterelectrode with a higher number of leads but fewer leads are needed for the actual electrodes resulting overall in a reduced number of leads.

Figure 2:
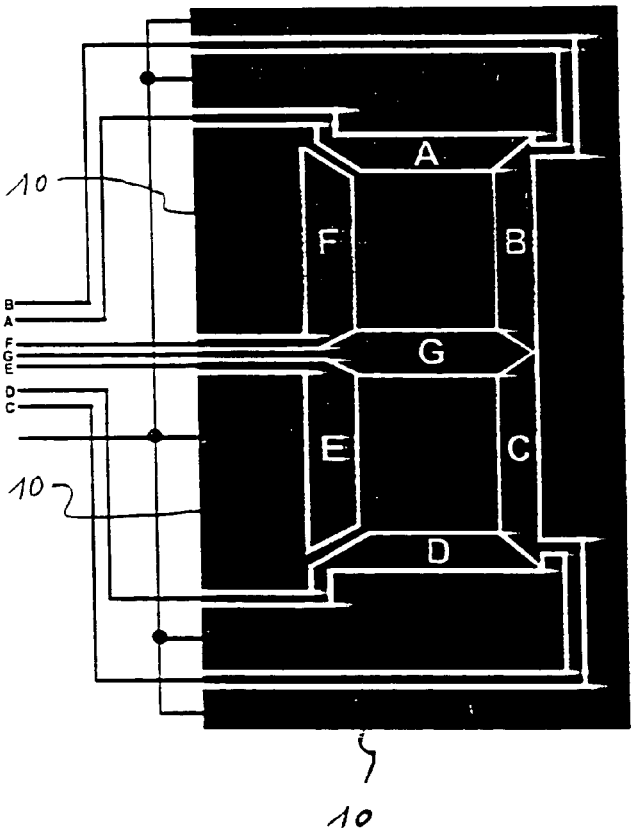

The way in which the present invention functions is illustrated by FIG. 2:

FIG. 2 shows the segments that are mounted on one of the plates of the liquid crystal display. The conventional segments A to G as well as the inverse segments (10) according to the invention are present in this 7-segment display. The inverse segments fill out the display surface in the region in which there are no regular segments or leads. There must be no electrical contact between the inverse segments and the regular segments or their leads so that the inverse segments can be activated independently of the other segments; therefore the inverse segments do not completely fill out the display area but rather there are spaces between them which prevent an electrical short-circuit. The distance between the segments or between the segments and the inverse segments is in the range of ca. 50–100 $\mu$m. It is also possible to provide the inverse segment or inverse segments in only a part of the display area.

When there is a failure of a regular segment, the inverse segments enable an observer to detect the absence of the defective segment by means of the frame formed by the inverse segment. Hence it is not necessary for the inverse segments to completely fill out the area that is not covered by the regular segments. Rather it is important that the inverse segments together with the regular segments form an optically perceptible continuous area. Thus a defective segment can be recognized to be absent in this area when all segments are activated.

Figure 3:
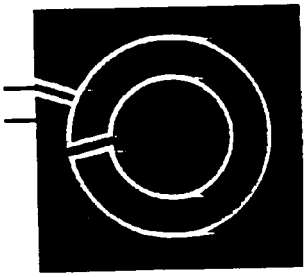

FIG. 3 shows an arrangement of segments according to the invention to represent a zero. In addition to a segment for representing the zero, there is an inverse segment which essentially comprises the inner space and the surrounding region of the zero.

In the case of electrodes shown in FIGS. 2 and 3 the counterelectrode can be composed of a conductive surface of essentially the same size. The segments and inverse segments of the counterelectrode have an essentially congruent structure except that the respective leads to the segments are in different areas so that the leads are not visible in the display when the segments are activated.

The function of the liquid crystal display can be checked by the following method:

The display device can be designed such that it appears uniformly bright without activation. Within the scope of the present invention a Schadt-Helfrich display with crossed polarizers is preferably used for this. The liquid crystalline substance is preferably selected such that it results in an optical rotation of 90° or 270° without an applied voltage.

In order to check the display, the segments as well as the inverse segments are activated so that the display appears dark to the observer. If all segments are operating the display is uniformly dark. However, if there is a failure of one of the segments, there is no potential difference between this segment and the counterelectrode and the area of this segment appears bright. The inverse segments allow an observer to identify the shape of the defective segment which remains as a bright space on the otherwise dark display. Thus the functioning segments and inverse segments form a frame against which a failed segment stands out inversely. An instrument with such a display can consequently carry out a display check when it is switched on or actuated by the operator as mentioned above by activating all segments and inverse segments for a few seconds in order to enable the observer to detect defective segments. After this check the segments of the display can be activated as for commercial displays i.e. the inverse segments only have to be activated when it is intended to carry out a new check of the display. Such a display has the advantage that the electronic circuits and activation algorithms of conventional displays only have to be slightly modified—it is only necessary to jointly activate the segments and inverse segments to carry out the check.

According to the invention it is also possible to carry out the opposite procedure i.e. a display is designed to appear uniformly dark to the observer when it is switched off. This can for example be achieved with the Schadt-Helfrich display in which the polarizers are orientated in the same direction. When such a display is switched on, firstly all segments and inverse segments are activated according to the invention. If defective segments are present these stand out as dark areas against the otherwise bright display. The information to be represented can be displayed by two methods:

In the first procedure the segments to be displayed are activated such that they appear bright against an otherwise dark display. The activated segments form transparent areas. If the display device is provided with background illumination the activated segments appear luminous to an observer. This operating mode can be used advantageously for displays which have to be read in the dark such as speedometers, car radios, clinical thermometers etc.

In a second procedure the display is activated inversely to the usual activation i.e. all segments that should not be displayed and the inverse segments are activated whereas the segments that are to be displayed are not activated and hence remain dark.

The known actuation devices for conventional liquid crystal displays can be used to activate a liquid crystal display according to the invention. The actuation devices only need to additionally have one or several electrical outputs for the inverse segments which can be used to selectively activate them (i.e. separately from the regular segments). Electronic actuation components for liquid crystal displays are described for example in the data book "Philips Bauelemente", (1989) published in Dr. Alfred Hüthing Verlag GmbH (see e.g. PCF 8576).

What is claimed is:

1. A system for the display of symbols which enables a visual recognition of defective segments, the system comprising:

a liquid crystal display having:

a transparent first plate, the first plate having transparent at least one conductive segments in a display area to represent symbols and at least one conductive inverse segment which fills out the area surrounding at least one conductive segments; and a second plate facing the first plate, wherein the second plate is conductive in regions that are opposite the at least one conductive segments in the first plate;

a liquid crystalline substance located in the space between the first and second plate; and an actuation device for the selective activation of the at least one conductive segments and of the at least one inverse segment, wherein the activation system for a time interval, allows simultaneous activation of the at least one conductive segments and of the at least one inverse segment, such that during the time interval it is possible to recognize failure of any portion of at least one conductive segments by their inverse appearance relative to the at least one inverse segment.

2. The system of claim 1, wherein an electrical potential is applied separately to the at least one conductive segments and to the at least one inverse segment.

3. The system of claim 1, wherein the shape and size of the regions on the second plate essentially correspond to the at least one conductive segments of the first plate.

4. The system of claim 1, wherein the second plate has at least one inverse segment the shape and size of which essentially corresponds to that of the at least one inverse segment of the first plate.

5. The system of claim 1, wherein the second plate and its conductive regions are transparent.

6. The system of claim 1, wherein the second plate is reflective or a reflecting layer is located behind the second plate.

7. The system of claim 1, further comprising two polarizers between which the liquid crystalline substance is disposed.

8. The system of claim 1, further comprising a switch which can initiate a simultaneous activation of the segments and of the at least one inverse segment.

9. A method for operating a liquid crystal display which enables visual recognition of defective segments, using a liquid crystal display having a first and a second plate which face one another and a liquid crystalline substance located in the space between the first and second plate, the first plate being transparent and having essentially transparent conductive segments in a display area to represent symbols and the second plate being conductive at least in the regions that are opposite to the conductive segments of the first plate, and the first plate has at least one conductive inverse segment which fills out the area surrounding at least one of the conductive segments, the method comprising:

a) simultaneously activating all conductive segments of the first plate and of the at least one inverse segment for a first time interval to enable an observer to detect failed conductive segments by their inverse appearance relative to the at least one inverse segment; and b) displaying symbols by activating the conductive segments to be displayed, and the conductive segments that are not to be displayed and the at least one inverse segment remain inactivated.

10. The method of claim 9, wherein the display area appears dark when carrying out step a) and defective signals stand out bright.

11. The method of claim 9, wherein the display area appears bright when carrying out step a) and defective signals stand out dark.

12. The method of claim 9, wherein symbols are displayed in step b) by activating the segments that are not to be displayed and all existing inverse segments.

* * * * *